US006688427B2

(12) United States Patent
Cole

(10) Patent No.: US 6,688,427 B2
(45) Date of Patent: Feb. 10, 2004

(54) CONCRETE MOUNTED SAFETY STANCHION AND APPARATUS AND METHODS FOR MOUNTING TO CONCRETE

(75) Inventor: Barry A Cole, Thornton, CO (US)

(73) Assignee: MC Enterprises International, Inc., Denver, CO (US)

( * ) Notice: Subject to any disclaimer, the term of this patent is extended or adjusted under 35 U.S.C. 154(b) by 0 days.

(21) Appl. No.: 10/212,890

(22) Filed: Aug. 7, 2002

(65) Prior Publication Data

US 2002/0189901 A1 Dec. 19, 2002

Related U.S. Application Data

(62) Division of application No. 09/770,734, filed on Jan. 26, 2001, now Pat. No. 6,439,344.

(51) Int. Cl.[7] ..... A47L 3/02; E06C 7/18

(52) U.S. Cl. ..... 182/113; 182/3

(58) Field of Search ..... 182/113, 45, 3; 52/125.4, 127.2, 127.1, 736.1; 248/229.24, 229.25, 228.5, 228.6; 256/DIG. 6, DIG. 5, 32, 65, 67, 59

(56) References Cited

U.S. PATENT DOCUMENTS 5,481,846 A * 1/1996 Macchietto ..... 52/720.1
6,173,809 B1 * 1/2001 Cole et al. ..... 182/3

* cited by examiner

*Primary Examiner*—Hugh B. Thompson
(74) *Attorney, Agent, or Firm*—Brian D. Smith, P.C.

(57) ABSTRACT

Safety stanchions for supporting a safety cable and the like are disclosed. One disclosed embodiment includes a tapered tubular post having a lower end for attachment to a support base at an oblique angle and an upper end for supporting the safety cable. A unique base or base assembly for mounting a stanchion upon a structural member such as an I beam is also disclosed. Various unique safety stanchion apparatus and methods for mounting safety stanchions to concrete floors, beams and girders and other concrete structures are also shown.

10 Claims, 9 Drawing Sheets

FIG. 2
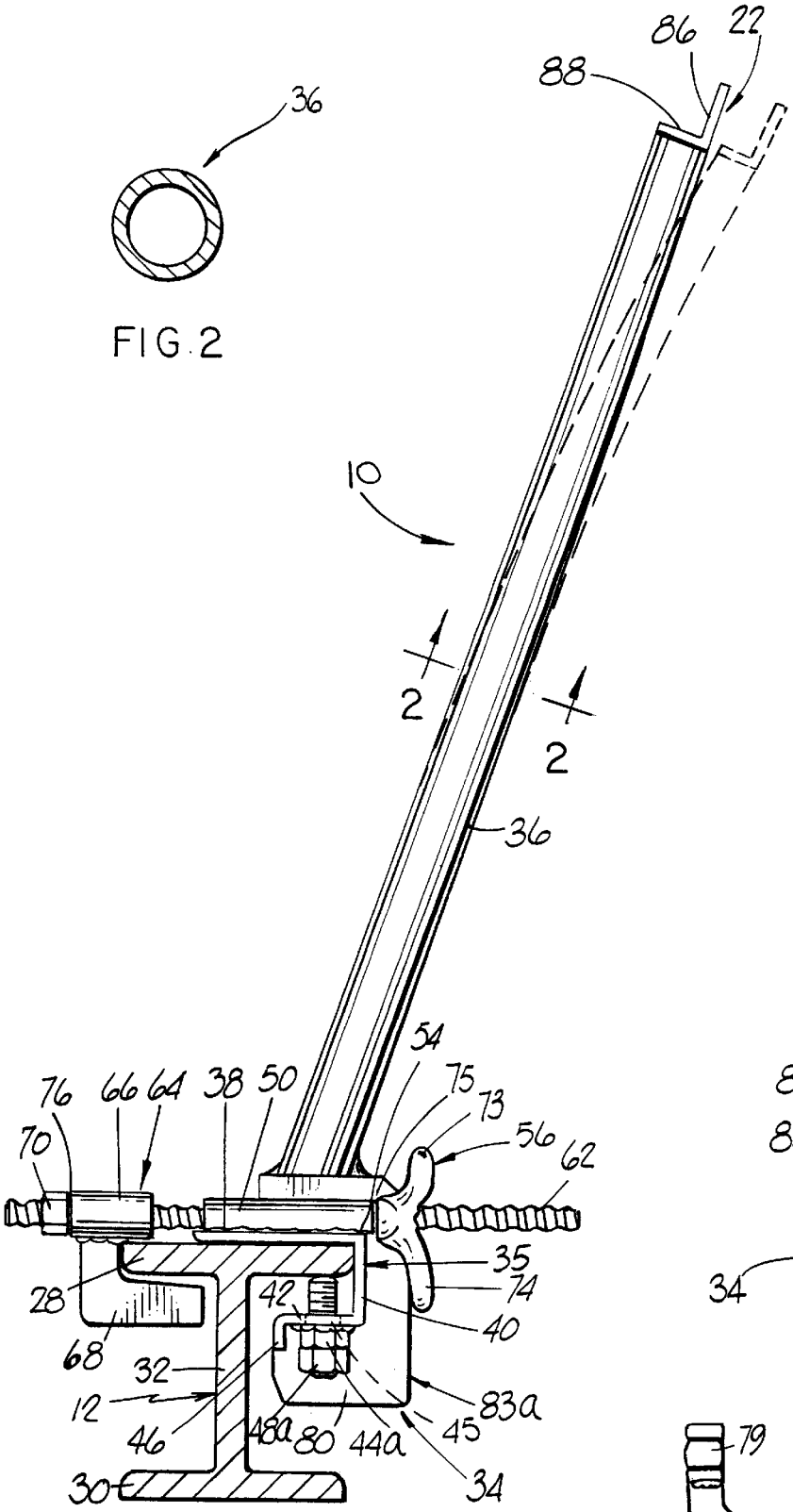
FIG. 1
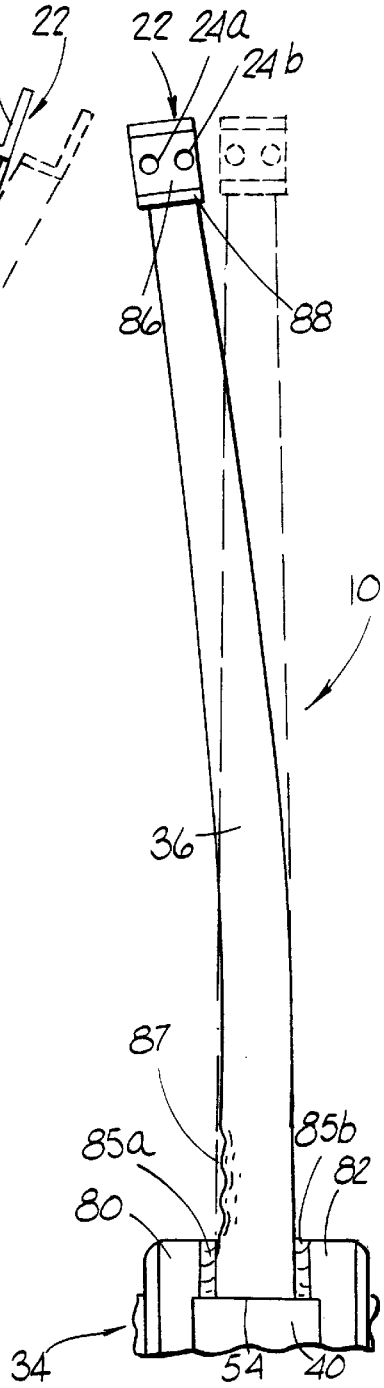
FIG. 3
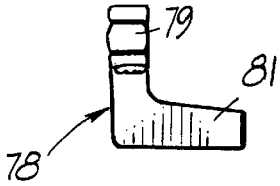
FIG. 4

CONCRETE MOUNTED SAFETY STANCHION AND APPARATUS AND METHODS FOR MOUNTING TO CONCRETE

This is a division of application Ser. No. 09/770,734, file Jan. 26, 2001, now U.S. Pat. No. 6,439,344.

TECHNICAL FIELD

The present invention relates generally to products and methods for providing fall protection systems for construction workers, maintenance workers, and others who work or walk upon elevated structures. More particularly, it relates to fall protection systems which employ safety stanchions mounted to the elevated structure so as to anchor and support safety cables.

BACKGROUND OF THE INVENTION

During the construction of a bridge, building or other structure, it is common for workers to work and walk upon structural or architectural steel beams forming a part of the construction. Obviously, it is important but difficult to protect such workers and others from harm when they inadvertently slip and fall from elevated beams.

It is also important, for the purpose of controlling construction costs and facilitating rapid construction, that any fall protection system which is put in place to protect the workers be relatively inexpensive, relatively quick and easy to install, and later dismount, and cause little interference with the construction process itself.

Most conventional fall protection systems to which the present invention relates involve systems for supporting the worker with a safety cable that may be anchored and supported in various ways. Once a safety cable is anchored and supported, workers may obtain support by attaching themselves to the safety cable, as, for example, by way of a safety lanyard attached both to the cable and to a harness worn by the worker.

Unfortunately, in most superstructures where persons are called upon to walk and work upon elevated beams, there are few or no suitable anchoring points for attaching safety cables. Attaching the cables directly to the beams beneath the workers' feet could increase the likelihood of tripping, and could also increase the potential fall distance.

Even if there are elevated anchoring points in the superstructure, the location of those points could cause the safety cable to extend directly above the very beam upon which the worker wishes to walk and work, thereby hindering the worker's actions. In comparison to such anchoring points, it would be preferable, instead, to anchor a safety cable in such a way that, as the safety cable extends along the beam, it is suspended not just above the beam but also off-set slightly to one side of the beam, so that it will not unnecessarily hinder the worker as he or she works upon or walks along the beam's upper surface.

A means of providing fall protection with such an elevated but off-set cable positioning is disclosed in U.S. Pat. No. 5,307,897, wherein a safety stanchion employs both a first and a second lock means, with the first lock means depending upon properly torqued bolts (which could be subject to failure from loss of friction if worn or insufficiently tightened), and with the second lock means being mounted to a post and being somewhat complex, comprising, for example, a ratchet lock mechanism comprising a strap made of nylon or another synthetic material (which sunlight, chemicals or a nearby heat source, such as nearby welding, could render subject to failure). That previously disclosed safety stanchion is preferably used with a safety cable having an in-line shock absorber.

U.S. Pat. No. 6,173,809 (the '809 patent) which discloses an invention of which I am a co-inventor also provides a safety stanchion with an elevated and preferably off-set cable positioning. However, it does so with various other means, none of which, for example, require a ratchet lock mechanism or a nylon or synthetic strap as shown in the aforementioned art. The invention of the '809 patent also provides a safety stanchion having a post that preferably can, by flexing and by permanently deforming without failing, reduce and absorb at least some of the shock and sudden loading caused by a worker's fall from a beam, without the need for a safety cable having an in-line shock absorber.

As previously noted, there are advantages to be gained by providing a fall protection system that is relatively inexpensive, that may be quickly and easily mounted to and dismounted from an elevated beam, and that will support and anchor a safety cable above and slightly to the side of the elevated beam. The invention of the '809 patent teaches such a safety stanchion.

One embodiment of the invention of the '809 patent provides a safety stanchion for mounting upon a surface such as structural I or H shaped beam which are typically found in the superstructure of a bridge, a building or some other structure being built.

This safety stanchion includes a tapered tubular post having a lower end for attachment to a support base at preferably an oblique angle and an upper end for supporting a safety cable and the like. Due to its tapered shape, the post's upper end has an outside diameter which is less than that of its lower end. The post also preferably has a wall thickness of less than 0.125 inches and is frustoconically shaped. In addition, the post is preferably made out of an energy absorbing, elastic-like, high strength steel such as A595 grade steel which in cooperation with the post's wall thickness and tapered, preferably frustoconical, shape is believed to render the post capable of inelastically deforming before it fails, thereby better able to break a worker's fall without actually breaking in half. Fail or failure of the post as used herein refers to a post which has actually broken or buckled to a point where it is no longer capable of providing any significant resistant to lateral forces or other forces tending to cause bowing of the post.

As will be appreciated, the attachment of the post's lower end to its base at an oblique angle enables the suspension of safety cables above, but slightly to the side, of the particular beam or surface upon which the safety stanchion is mounted.

The stanchion also preferably includes a cap, having two bores, which is firmly secured to the upper terminus of the post, and by means of which safety cables can be easily attached to the tapered tubular post, and therefore to the safety stanchion itself, such as with simple, conventional devises.

In the preferred safety stanchion of this type, the tapered post is capable of flexing and permanently (or inelastically) deforming without failing, in response to sudden loads (within its design limits) that might occur when a person who is attached to the stanchion via a conventional safety cable falls from an elevated beam or similar surface upon which the stanchion is mounted.

The invention of the '809 patent also provides a unique base or base assembly for mounting a stanchion upon a structural member such as an I beam, H beam or other structural member having flange portions, regardless of the, structural member's orientation to the horizon, i.e. vertical, horizontal or other disposition. In its broadest sense, the base has a mounting assembly or means which includes first jaw means for engaging a first portion of a structural beam and opposing second jaw means for engaging a second portion of the beam. The mounting assembly also includes right and left rod assemblies which respectively cooperate with the first and second jaw means for drawing the jaw means together to clamp a beam, typically the flange portions of a structural beam which extend outwardly from the center section of a typical structural I or H beam. The rod assemblies are preferably oriented with respect to each other so that their longitudinal axes converge towards each other. A preferred angle of convergence may extend up to 90 degrees as measured by the included angle defined by the longitudinal axes of the rod assemblies.

As used herein, converge means to draw closer to or approach each other and such converging, non-parallel positioning of the rods enables better clamping of the beam. Specifically, the converging rods are believed to be better able to resist both twisting and longitudinal motion along the beam (sometimes called "walking"), in response to vibration, twisting or other forces during the arrest of a worker's fall.

In a preferred embodiment of the invention of the '809 patent, the rod of each rod assembly is provided with aggressive threads on the order of 3 to 7.5 threads per inch for cooperating with complementary threaded first and second internally threaded members which in turn respectively cooperate with the first and second jaw means of the mounting assembly to clamp a structural beam when one of the internally threaded members, preferably a wing nut, is tightened by threading it in a direction which causes the jaw means to draw together and clamp a beam disposed between the jaw means. The aggressive threads enable a workman to install the stanchion on a beam very quickly since they cause the jaw means to close and thereby clamp a beam disposed between the jaw means with only a few turns of one of the internally threaded members.

Another safety stanchion of the invention of the '809 patent for mounting on a structural beam and the like has a sleeve on the stanchion's base for slidably receiving an end of the stanchion's post. Fastening means such as set screw type bolts are also provided for securing the post's end in the sleeve when it is slidably received therein. The sleeve may be integral with the base or rigidly affixed to the base for example by welding it to the base. The sleeve may also be positioned or oriented on the base so that the base may be mounted upon either vertically disposed I beams, i.e. columns, or horizontally disposed I beams. A typical post used in conjunction with this base is L-shaped and as shown in the drawings the lower end of the L-shaped post is slidably received in the sleeve.

In addition and as will be appreciated, all safety stanchions of the invention of the '809 patent provide an effective fall protection system, which is lightweight, simple, relatively unaffected by sunlight, chemicals and indirect heating, relatively quick and easy to mount upon a beam by hand or with a simple tool, capable of supporting and anchoring safety cables above but to the side of the mounted beam, where they will not unnecessarily hinder a worker on the beam, inherently able to reduce and absorb, through flexion and through permanent deformation, some of the shock and sudden load caused by a worker's fall from the beam, and better able to resist twisting and longitudinal motion upon the beam.

While the invention of the '809 patent is easily attachable to I beams and other structural members, a need still exists for a safety stanchion which is directly and easily attachable to a concrete structure. In addition, a need exists for apparatus and methods for attaching existing I beam mounted safety stanchions to concrete.

DISCLOSURE OF THE INVENTION

The present invention builds upon the invention of the '809 patent and the prior art by providing a unique safety stanchion for mounting directly to concrete. The unique stanchion includes a post having first and second ends, means for supporting a safety cable at said first end of said post and a base attached to the second end of the post for mounting the post on a flat surface of a concrete structure. The base includes a mounting plate having a generally flat bottom surface for placement against the flat surface of the concrete structure as well as a top surface and a plurality of holes extending through the plate from the bottom surface to the top surface.

In addition, the present invention provides several apparatus and methods for mounting any type of safety stanchion to concrete including the stanchions of the '809 patent, the prior art and the unique safety stanchion of the present invention for being mounted directly to concrete.

BRIEF DESCRIPTION OF THE DRAWINGS

The accompanying drawings illustrate and provide views of a preferred embodiment of the invention of the '809 patent which is incorporated herein by reference as well as the present invention. Other features, objects and advantages of the present invention as well as the invention of the '809 patent will appear in and be apparent from the following detailed description, when reference is made to the accompanying drawings.

In the accompanying drawings:

FIG. 1 is a side elevational view, partly in phantom, of a safety stanchion of the invention of the '809 patent, mounted to a structural I-beam illustrated in section. The phantom view shows the stanchion in a bowed position which is a position it will assume when subjected to forces causing it to bow as shown.

FIG. 2 is a cross-sectional view of the safety stanchion of FIG. 1 taken along lines 2—2 thereof.

FIG. 3 is a partial, broken away, front elevational view, partly in phantom, of the safety stanchion of FIG. 1. Again, the phantom view shows the stanchion in a bowed position which is a position it will assume when subjected to forces casing it to bow as shown.

FIG. 4 is a side elevational view of an alternative flange hook assembly which may be used in the safety stanchion of FIG. 1.

FIG. 5 further illustrates a portion (broken away) of a fall protection system provided by the invention of the '809 patent, and further illustrates an I-beam (broken away).

DETAILED DESCRIPTION OF PREFERRED EMBODIMENTS

FIGS. 1–3, 5 & 6 illustrate a flexible and deformable safety stanchion 10 of the invention of the '809 patent, mounted upon an I-beam 12.

Figure 5:
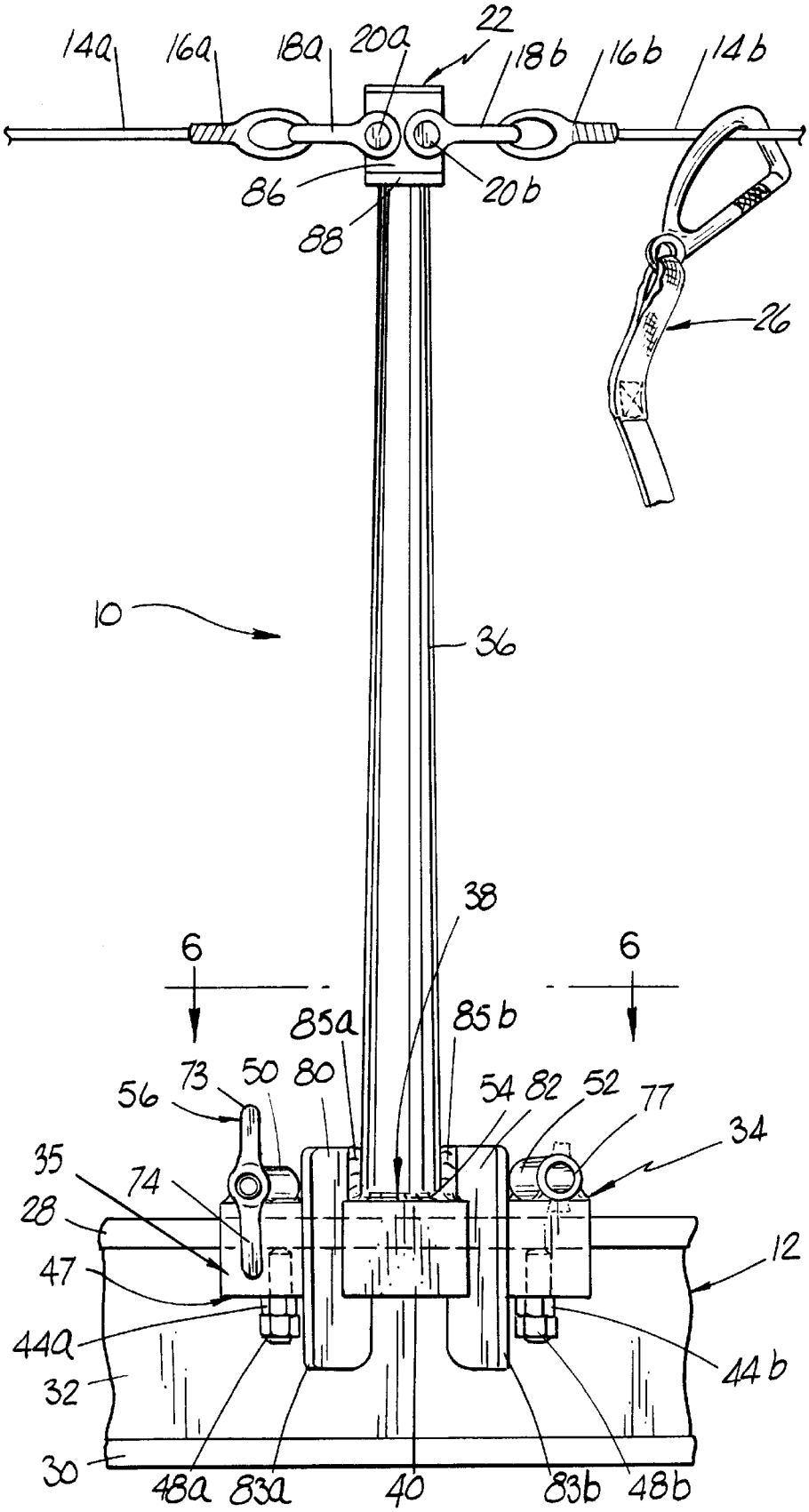
FIG. 5 is a partial front elevational view of the safety stanchion of FIG. 1, shown complete except for the omission of the right wing nut and the right quick-thread rod (which were omitted to provide an unobstructed view of the first right rod receiver)

As illustrated in FIG. 5, safety stanchion 10 serves as a support for suspending two conventional safety cables 14*a* and 14*b*, each of which is preferably supported at its other end by another safety stanchion 10 (not shown). The safety cables 14*a*, 14*b* are provided with looped ends 16*a*, 16*b* and are respectively anchored to the safety stanchion 10 by means of conventional devises 18*a*, 18*b* that are respectively fitted with clevis pins 20*a*, 20*b*.

Clevises 18*a* and 18*b* are passed, respectively, through the looped ends 16*a* and 16*b*. The devises 18*a* and 18*b* are both then pinned to a cap 22 at the top of the safety stanchion 10, by the passage of their respective clevis pins 20*a* and 20*b* through the two bores 24*a* and 24*b* (illustrated in FIG. 3) that are provided in the cap 22, with clevis pin 20*a* passing through bore 24*a* and clevis pin 20*b* passing through bore 24*b*.

Other forms of cap would be possible, as would other methods of attaching a safety cable to the cap. For example, when a safety stanchion 10 is used at an intermediate position in an extended line of safety stanchions 10 a different form of cap could (but need not) be used, such as a pass-through type cap like that taught by U.S. Pat. No. 4,037,824.

As illustrated in FIG. 5, safety cable 14*b* supports a conventional lanyard 26 (shown broken away), which is clipped and thereby slidingly attached to the safety cable 14*b*. As known to those familiar with the art, the lanyard 26 connects with a belt or harness (not shown) that is worn by a worker present on the superstructure of a building, a bridge, or some other structure. A preferred lanyard for use in accordance with the present invention is of the shock absorbing type.

It should be noted that it is not necessary to attach two separate safety cables to the safety stanchion 10, and for some of its applications (i.e. when supporting a single cable or when used as an end point) it would need to support only a single cable connected to only one adjacent stanchion. Therefore, either safety cable 14*a* or safety cable 14*b* could be omitted without preventing the safety stanchion 10 from providing useful support to a worker clipped to whichever safety cable remained.

Furthermore, for some applications of the safety stanchion 10 (e.g. when the safety stanchion is used at an intersection of intersecting beams for which safety cables are provided) a safety cable could extend and be supported horizontally but perpendicularly to the safety cables 14*a*, 14*b* shown in FIG. 5. In such an application, the perpendicular safety cable could be attached to the cap 22 of the safety stanchion 10, or could instead be joined (either fixedly or slidingly) at one end to a point on one of the safety cables 14*a* or 14*b*; at the other end, the perpendicular safety cable could be joined to the cap 22 of another safety stanchion, or could instead be joined (either fixedly or slidingly) to another safety cable, supported by other safety stanchions 10, that is separate from but parallel to the joined safety cable 14*a* or 14*b*.

So that it may provide useful support, the safety stanchion 10 is mounted upon an I-beam 12, a typical example of which is illustrated in FIGS. 1 and 5. The typical I-beam 12 has an upper flange 28, a lower flange 30, and a medial support panel 32 (which may be solid, as shown, or instead include truss components). As best illustrated in FIG. 1, the safety stanchion 10 is preferably mounted upon the upper flange 28 of an I-beam 12.

The safety stanchion 10 may alternatively be flange mounted, in an equivalent manner, upon an H-beam (not shown) or a steel joist or other flanged structural member; therefore, as used herein the term "I-beam" may refer generally to an I-beam 12, an H-beam or a steel joist or other flanged structural member of sufficient strength. Furthermore, for some applications the safety stanchion 10 (or other derivations thereof) may be inverted and mounted to the lower flange 30 of the I-beam 12 or other overhead flanged structural member of sufficient strength, so as to suspend the safety stanchion below the I-beam 12 or other member.

FIGS. 1 and 5 illustrate that the safety stanchion 10 includes a base or base assembly, 34, a straight but tapered tubular post 36 and previously mentioned cap 22.

The base assembly 34 includes a channel member 35, comprising an upper portion 38, a vertical portion 40, a lower portion 42, a vertical lip 46, and two equivalent threaded hexagonal nuts 44*a* and 44*b* that are rigidly attached, preferably welded, to lower portion 42 and that are aligned with two bores 45 (only one of which is shown) provided in lower portion 42 for receiving bolts 48*a*, 48*b*.

The upper portion 38, vertical portion 40 and lower portion 42 of the channel member 35 are preferably constructed in one piece from a single plate or other piece of steel, cut and bent or otherwise formed to include them and as such comprise a member referred to herein and in the claims appended hereto as the first jaw means. As illustrated in FIG. 1, this first jaw means or channel member 35 engages a first portion, specifically a first or right flange portion of the upper flange 28 of the illustrated I-beam 12. As also illustrated, the upper portion 38 is bent at right angles to the vertical portion 40, which in turn is bent at right angles to the lower portion 42. By means of the upper portion 38, vertical portion 40 and lower portion 42 of its channel member 35, the base assembly 34 defines an open channel for receiving the right side (as viewed in FIG. 1) of upper flange 28 of I-beam 12. As best illustrated in FIG. 1, when the safety stanchion 10 is mounted upon the upper flange 28 of a horizontal I-beam 12, the underside of the upper portion 38 of the channel member 35 rests horizontally upon and above the upper flange 28, and the lower portion 42 of the channel member 35 is suspended below the upper flange 28 (but above the lower flange 30) by the vertical portion 40 of the channel member 35. As so suspended, the lower portion 42 of the channel member 35, except for its vertical lip 46, is approximately perpendicular to the vertical portion 40 of the channel member 35.

As shown in FIG. 1, it is preferable that the lower portion 42 of the channel member 35 be dimensioned so that it does not extend as far from the vertical portion 40 as does the upper portion 38, so that even when the safety stanchion 10 is mounted upon smaller beams the lower portion 42 will not engage the medial support panel 32 of the I-beam 12, and will therefore avoid interference with the mounting. Referring to FIG. 5, bolts 48*a* and 48*b* are threaded, respectively, into and completely through the two threaded hexagonal nuts 44*a* and 44*b*, starting from below the lower portion 42 of the channel member 35, so that each of the bolts 48*a* and 48*b* is threaded into the channel member 35.

When the safety stanchion 10 is securely mounted upon the upper flange 28 of a horizontal I-beam 12, the two bolts 48*a* and 48*b* (also referred to herein in the claims appended hereto as the jaw opening adjustment means) are tightened until they contact the underside of the upper flange 28 of the I-beam 12.

As illustrated in FIG. 5, the base assembly 34 also includes a left rod receiver 50 and a right rod receiver, 52 of equivalent size and shape, each of which is preferably constructed from a length of steel pipe. Also as illustrated in FIG. 5, the left rod receiver 50 and the right rod receiver 52 both rest upon and are both longitudinally supported by the upper portion 38 of the channel member 35, to which both are welded and therefore secured firmly in position.

However, in that position the left rod receiver 50 and the right rod receiver 52 also partially extend slightly beyond (and, as viewed in FIG. 1, to the right of) the upper front edge 54 of the upper portion 38 of the channel member 35, so that the portions of those rod receivers 50 and 52 that so extend do not rest upon the upper portion 38. The purpose for this slight extension is to provide clearance between the vertical portion 40 of the channel member 35 and both the left wing nut 56 and the right wing nut (not shown) when those wing nuts are positioned, respectively, against the left rod receiver 50 and the right rod receiver 52.

The longitudinal axis of the left rod receiver 50 and the longitudinal axis of the right rod receiver 52 are located in the same plane, hereinafter called the "axis plane," but they are not parallel. Instead, as best illustrated in FIG. 6, those longitudinal axes tend to converge as the left rod receiver 50 and the right rod receiver 52 extend along and across the upper portion 38 of the channel member 35 by moving away from the upper front edge 54 of that upper portion 38.

Figure 6:
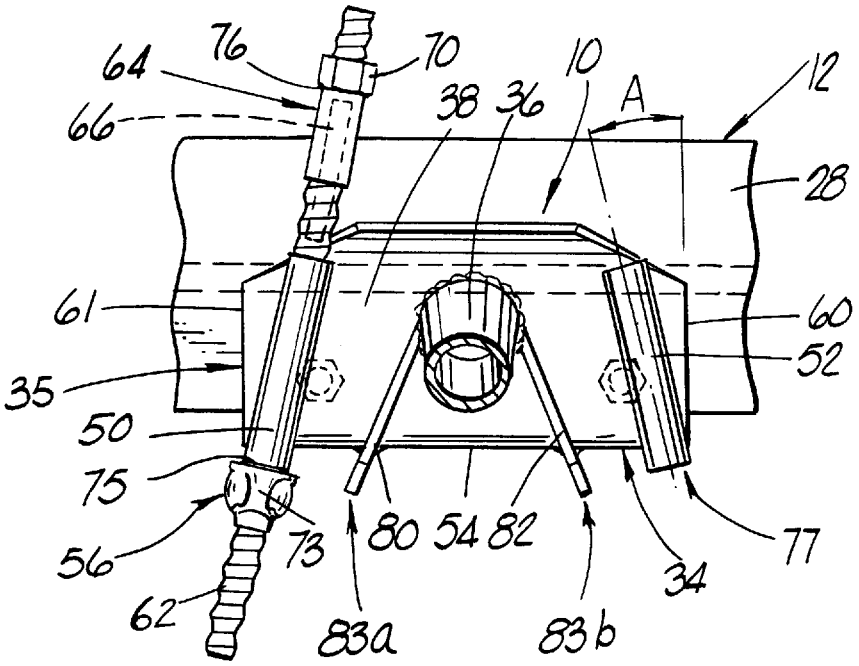
FIG. 6 is a cross-sectional view of the safety stanchion of FIG. 5 taken along lines 6—6 of FIG. 5.

Angle A (as illustrated in FIG. 6) from the longitudinal axis of the right rod receiver 52 to a line that is parallel to and directly above the upper right edge 60 of the upper portion 38 of the channel member 35 (but that is drawn in the axis plane as previously defined) is preferably ten (10) degrees clockwise, but may range from three (3) to forty five (45) degrees clockwise.

Similarly, the angle (not separately identified in FIG. 6) from the longitudinal axis of the left rod receiver 50 to a line that is parallel to and directly above the upper left edge 61 of that upper portion 38 (but that is drawn in the axis plane) is preferably ten (10) degrees counterclockwise, preferably, but may also range from three (3) to forty five (45) degrees counterclockwise. Accordingly, the "included angle" defined by the longitudinal axes of the left and right rod receivers 50, 52 (which are also the longitudinal axes of the left and right rod assemblies as the terms are used in the claims appended hereto) is twice angle A and therefore is preferably about twenty (20) degrees. However, as indicated above it may range anywhere from six (6) to ninety (90) degrees. Generally, however, it is believed that best results are obtainable if the included angle is between ten (10) and thirty (30) degrees.

This converging, non-parallel positioning for the left and right rod receivers 50, 52 is advantageous because it is believed to provide a more effective grip and to resist, more effectively, both twisting and longitudinal motion (or so-called "walking") by the safety stanchion 10 relative to or along the longitudinal axis of the beam, in response to vibration, twisting or other forces during the arrest of a worker's fall.

The hollow interior of the left rod receiver 50 is not provided with threads; and neither is the hollow interior of the right rod receiver 52.

The base assembly 34 also includes a left quick-thread rod 62, and a right quick-thread rod (not shown) of equivalent size and shape, each of which has external threads along its entire length, and each of which is preferably constructed from a straight length of steel rod with aggressive threads of three (3) to seven and one-half (7½) pitch, i.e. 3 to 7½ threads per inch.

The base assembly 34 also includes a left flange hook assembly 64, and a right flange hook assembly (not shown), both of which are more generically referred to herein in the claims appended hereto as the second jaw means. The left flange hook assembly 64 includes a rod receiver 66. Likewise, the right flange hook assembly includes an equivalent rod receiver. The left flange hook assembly 64 also includes a flange hook portion 68. Likewise, the right flange hook assembly also includes an equivalent flange hook portion.

The rod receiver 66 of the left flange hook assembly 64 is preferably constructed from a length of steel pipe (and so is the equivalent rod receiver of the right flange hook assembly). The flange hook portion 68 of the left flange hook assembly 64 is preferably cut or otherwise formed, approximately in an L-shape, from a single plate or other piece of steel (and so is the equivalent flange hook portion of the right flange hook assembly). The hollow interior of the rod receiver 66 of the left flange hook assembly 64 is not provided with threads (and neither is the hollow interior of the rod receiver of the right flange hook assembly).

As best illustrated in FIG. 1, the flange hook portion 68 of the left flange hook assembly 64 is welded to and depends from the underside of the rod receiver 66 of that assembly. The right flange hook assembly is equivalently assembled by welding its flange hook portion to the underside of its rod receiver.

The base assembly 34 also includes a threaded hexagonal left nut 70 and an equivalent threaded hexagonal right nut (not shown) which are broadly referred to in the claims appended hereto as the second internally threaded members. In addition, the left wing nut 56 and an equivalent right wing nut (not shown) are provided as previously mentioned which are broadly referred to in the claims appended hereto as the first internally threaded members. The threaded hexagonal left nut 70 and the left wing nut 56 are both provided with internal threads suitable for allowing them to be threadably mounted coaxially upon the left quick-thread rod 62, so as to permit the left quick-thread rod to pass completely through, and to protrude from both sides of, their respective hollow, threaded interiors. Equivalently, the threaded hexagonal right nut and the right wing nut are both provided with internal threads suitable for allowing them to be threadably mounted coaxially upon the right quick-thread rod, so as to permit it to pass completely through and protrude from both sides of their respective hollow, threaded interiors.

Preferably, the left wing nut 56 and the equivalent right wing nut are each constructed to include (for the purpose of facilitating manual rotation, or other deliberate rotation, and subsequent stationary retention upon the particular quick-thread rod which passes through it) an upper wing 73 and a lower wing 74 that are relatively shaped and sized so that the lower wing 74 is significantly longer and heavier than the upper wing 73, as illustrated in FIG. 1, or is otherwise configured so that after the completion of manual rotation (or other deliberate rotation) the lower wing 74 will tend, to a greater extent than the upper wing 73, to maintain the lowermost position so as to help prevent the entire wing nut from further rotation. Such a preferred wing nut is advantageous for use with the preferred safety stanchion 10, in part because it tends, more than an alternative form of wing nut with indistinguishable wings, to prevent excessive loosening despite inadvertently being struck and despite vibration sometimes transmitted to the safety stanchion 10 during normal use.

As best illustrated in FIG. 1, when the safety stanchion 10 is mounted upon the upper flange 28 of a horizontal I-beam 12, the left quick-thread rod 62 is inserted longitudinally and completely through the hollow interior of the left rod receiver 50, and it is also inserted longitudinally and completely through the hollow interior of the rod receiver 66 of the left flange hook assembly 64. In an equivalent manner, although hidden from view in FIG. 1 and omitted from other views, when the safety stanchion 10 is so mounted the right quick-thread rod is inserted longitudinally and completely through the hollow interior of the right rod receiver 52 and the hollow interior of the rod receiver of the right flange hook assembly.

The left quick-thread rod 62 is of sufficient length so that, even after both such insertions have been completed, the left quick-thread rod substantially protrudes from the front face 75 of the left rod receiver 50 and substantially protrudes from the rear face 76 of the rod receiver 66 of the left flange hook assembly 64. The right quick-thread rod is of equivalent length, and it is equivalently inserted longitudinally and completely through, so as to equivalently protrude from, the right rod receiver and the rod receiver of the right flange hook assembly.

As best illustrated in FIG. 1, when the safety stanchion 10 is mounted upon the upper flange 28 of a horizontal I-beam 12, the left wing nut 56 and the threaded hexagonal left nut 70 are both threadably mounted to the left quick-thread rod 62, and positioned so that the left rod receiver 50 and the left flange hook assembly 64 are between them, and so that the left wing nut 56 engages and presses firmly against the front face 75 of the left rod receiver 50 and the threaded hexagonal left nut 70 engages and presses firmly against the rear face 76 of the rod receiver 66 of the left flange hook assembly 64. In an equivalent manner, although hidden from view in FIG. 1 and omitted from other views, when the safety stanchion 10 is so mounted, the right wing nut and the threaded hexagonal right nut are both threadably mounted to the right quick-thread rod, and positioned so that the right rod receiver 52 and the right flange hook assembly are between them, and so that the right wing nut engages and presses firmly against the front face 77 of the right rod receiver 52 and the threaded hexagonal right nut engages and presses firmly against the rear face of the rod receiver of the right flange hook assembly.

In an alternate embodiment of the invention of the '809 patent, the threaded hexagonal left nut 70 and the left flange hook assembly 64 are replaced with a functionally equivalent left threaded flange hook assembly 78 that is illustrated in FIG. 4. Likewise, in that alternative embodiment the threaded hexagonal right nut and the right flange hook assembly are also replaced by a right threaded flange hook assembly (not shown), which is equivalent in size, shape and material to the left threaded flange hook assembly 78 illustrated in FIG. 4.

As illustrated in FIG. 4, the left threaded flange hook assembly 78 includes a threaded hexagonal nut 79, and a flange hook portion 81 that is welded to and depends from the underside of that threaded hexagonal nut 79, and that is preferably cut or otherwise formed from a single plate or other piece of steel. Likewise, the right threaded flange hook assembly includes an equivalent threaded hexagonal nut, and an equivalent flange hook portion that is welded to and depends from the underside of that threaded hexagonal nut (and is likewise preferably cut or otherwise formed from a single plate or other piece of steel).

Referring now to FIG. 5, base assembly 34 also includes a left gusset 80 and a right gusset 82 of equivalent size and shape, each of which is preferably cut or otherwise formed in one-piece from a plate or other piece of steel.

When the safety stanchion 10 is properly mounted upon the upper flange 28 of a horizontal I-beam 12, the left gusset 80 and the right gusset 82 stand vertically, as best illustrated in FIG. 5; however, they tend to converge toward one another, as best illustrated in FIG. 6, as they extend from their respective free edges 83*a* and 83*b* toward the tapered tubular post 36. The preferred angle of their convergence is approximately as illustrated in FIG. 6, so that the left gusset 80 (as viewed in that figure) would preferably be angled approximately ten (10) degrees clockwise from a line drawn perpendicular to the upper front edge 54 of the upper portion 38 of the channel member 35, but could be angled from five (5) to at least thirty (30) degrees clockwise. Similarly, the right gusset 82 (as viewed in that figure) would preferably be angled approximately ten (10) degrees counterclockwise from such a perpendicular line, but could be angled from five (5) to at least thirty (30) degrees counterclockwise.

The left gusset 80 is shaped and dimensioned to fit snugly against the exterior surfaces of the channel member 35, as follows: as best illustrated in FIG. 5, the left gusset 80 fits snugly against the exterior of the vertical portion 40 of the channel member 35; as best illustrated in FIG. 6, the left gusset 80 fits snugly against the top of the upper portion 38 of the channel member 35; and as best illustrated in FIG. 1 (although partially hidden from view), the left gusset 80 fits snugly against the horizontal underside of the lower portion 42 of the channel member 35, and against the right surface (as viewed in that figure) of the vertical lip 46.

In an equivalent manner, the right gusset 82 also fits snugly against the exterior of the vertical portion 40 of the channel member 35, the top of the upper portion 38 of the channel member 35, the horizontal underside of the lower portion 42 of the channel member 35, and the right surface of the vertical lip 46.

An important purpose of the left gusset 80 and right gusset 82 is to provide additional strength and stability to the base assembly 34, and to the connection between the base assembly 34 and the tapered tubular post 36. Accordingly, the left gusset 80 is welded to the channel member 35 wherever the channel member 35 and the left gusset 80 come into contact; and (as best viewed in FIG. 3), the left gusset 80 is welded to the tapered tubular post 36, with the weld 85*a* viewed in that figure. Likewise, the right gusset 82 is welded to the channel member 35 wherever the channel member 35 and the right gusset 82 come into contact; and (as best viewed in FIG. 3), the right gusset 82 is welded to the tapered tubular post 36, with the weld 85*b* viewed in that figure.

As previously noted, the safety stanchion 10 includes, in addition to its base assembly 34, both the tapered tubular post 36 and the cap 22. The cap 22 is preferably formed in one piece from a plate or other piece of steel that has been bent or otherwise formed to include an upper portion 86 and a lower portion 88, which join at right angles as best viewed in FIG. 1.

The lower portion 88 of the cap 22, when viewed from above, is approximately square. Furthermore, the lower portion 88 is welded, and thereby firmly secured, to the upper terminus of the tapered tubular post 36, and is thereby supported by the tapered tubular post 36 as shown in FIG. 1.

As best illustrated in FIG. 3, the upper portion 86 of the cap 22 is approximately square (when viewed from the front or rear), and (as previously described) it is provided with two bores 24*a* and 24*b* that each pass completely through the upper portion 86 from front to back, for the purpose of receiving, respectively, clevis pins 20*a* and 20*b*. As previously described, the clevis pins 20*a* and 20*b* help to attach safety cables 14*a* and 14*b* to the cap, and therefore indirectly to the tapered tubular post 36 to which the cap 22 is welded.

As best illustrated in FIG. 5, the bottom of the tapered tubular post 36 is welded, and thereby firmly secured, to the top of the upper portion 38 of the channel member 35 that is included in the base assembly 34.

When the safety stanchion 10 is properly mounted upon the upper flange 28 of a horizontal I-beam 12, as best illustrated in FIG. 1, the tapered tubular post 36 extends upwardly from the top of the upper portion 38 of the channel member 35, at an oblique angle that is preferably from about fifteen (15) degrees to about twenty (20) degrees from vertical (and, accordingly, that is from about seventy (70) to about seventy-five (75) degrees from horizontal). Such an oblique angle occurs because the end of the tapered tubular post 36 that is welded to the upper portion 38 of the channel member 35 is, before it is so welded, first cut, preferably at an angle approximately fifteen (15) to twenty (20) degrees from the horizontal.

Preferably, the tapered tubular post 36 is approximately forty-two inches (42") in length. As illustrated in FIG. 2, throughout its length the tapered tubular post 36 has a cross section that is circular around both its exterior and interior circumferences. However, along its longitudinal axis, the tapered tubular post 36 is continuously tapered, giving it a frustoconical shape. At its bottom, it has an interior diameter of approximately two and seven-eighths of an inch (2⅞"); at its top, where it is welded to cap 22, it has an interior diameter of approximately two and one-eighths of an inch (2⅛").

Tapered tubular post 36 is preferably constructed from 11-gauge tubing of special high-strength, elastic steel (A595 grade), as purchased in tapered form from Valmont Industries of Valley, Nebr. However, it would be possible to construct the tapered tubular post from other energy absorbing steels or structural materials that have a high tensile strength to allow flexion and a large capacity to withstand, without fracturing, both flexion and permanent deformation when subject to the extreme forces of a worker's fall. To provide such elasticity and deformability in the post lengths typically contemplated by the subject invention, i.e. from about 30 to 42 inches, the tapered tubing should preferably be made from such energy absorbing steels and additionally have a wall thickness of less than 0.125 inches, however, not less than that provided by 15 gauge steel.

The tapered tubular post 36 is preferably constructed so as to flex and (if the load is sufficiently high) to permanently deform, controllably and without fracturing, in response to a substantial load (within its design limits) that is suddenly exerted upon it, as for example by the fall of a worker who is being supported by a safety cable that is being supported by the safety stanchion 10.

As preferably constructed, the tapered tubular post 36 tends to flex and (if the load is sufficiently high) to permanently deform, in response to such loads within its design limits, over its length in the characteristic manner best illustrated in FIG. 3: that is, it tends to flex and to permanently deform (as shown, for example, by the phantom lines in FIGS. 1 and 3), with portions of the surface of the tapered tubular post 36 becoming permanently rippled 87 near the bottom of the tapered tubular post, in response to the stresses produced by the load (as shown, for example, in FIG. 3). This tendency to flex and to permanently deform without fracturing enables the tapered tubular post 36, when dealing with loads within its design limits, to absorb shock and to handle those loads without breaking in two, and without buckling or kinking at a single point so as to fold over abruptly.

In order to mount the safety stanchion 10 securely upon the upper flange 28 of a horizontal I-beam 12, a worker preliminarily inserts the left quick-thread rod 62 completely through the first left rod receiver 50 and the second left rod receiver 66 of the left flange hook assembly 64. Similarly, the worker preliminarily inserts the right quick-thread rod completely through the first right rod receiver 52 and the second right rod receiver of the right flange hook assembly.

In order to mount the safety stanchion 10 securely upon the upper flange 28 of the horizontal I-beam 12, a worker will also preliminarily thread the left wing nut 56 upon the front portion of the left quick-thread rod 62, and, in an equivalent manner, the right wing nut (not shown) on the front portion of the right quick-thread rod (not shown). In addition, the worker will also preliminarily thread the threaded hexagonal left nut 70 upon the rear portion of the left quick-thread rod 62, and, in an equivalent manner, the threaded hexagonal right nut (not shown) upon the rear portion of the right quick-thread rod (not shown). The two bolts 48*a* and 48*b*, are also threaded into and through the two threaded hexagonal nuts 44*a* and 44*b*, respectively, and into and through the left bore 45 and the equivalent right bore (not shown), respectively, starting from below the lower portion 42 of the channel member 35.

However, during the preliminary steps of the mounting process as described above, no wing nut, threaded hexagonal nut, bolt or other part should be tightened or otherwise positioned in any way that would interfere with any subsequent mounting step.

As another preliminary step in mounting the safety stanchion 10 securely upon the upper flange 28 of the horizontal I-beam 12, a worker also preferably places the underside of the upper portion 38 of the channel member 35 so that, at least in part, it rests horizontally upon and above the I-beam's upper flange 28, with at least part of the lower portion 42 of the channel member 35 suspended below the upper flange 28 (but above the I-beam's lower flange 30) by the vertical portion 40 of the channel member 35. In addition, the worker preferably places the left flange hook assembly 64 so that the underside of at least part of its rod receiver 66 rests horizontally above the I-beam's upper flange 28, and so that at least part of its flange hook portion 68 is suspended below the upper flange 28 (but above the I-beam's lower flange 30). In an equivalent manner, the worker also preferably places the right flange hook assembly (unless the alternative right threaded flange hook assembly is to be used) so that the underside of at least part of its rod receiver rests horizontally above the I-beam's upper flange, and so that at least part of its flange hook portion is suspended below the upper flange 28 (but above the I-beam's lower flange 30).

The worker, to the extent possible, next moves the channel member 35 and the left flange hook assembly 64 relatively toward each other, along the left quick-thread rod 62 (while the underside of the upper portion 38 of the channel member 35 and, if it is present, the underside of the rod receiver 66 of the left flange hook assembly 64, continue to rest, at least in part, horizontally above the I-beam's upper flange 28, as previously described).

In an equivalent manner, the worker, to the extent possible, also moves the channel member 35 and the right flange hook assembly relatively toward each other, along the right quick-thread rod (while both the underside of the upper portion 38 of the channel member 35 and, if it is present, the underside of the rod receiver of the right flange hook assembly continue to rest, at least in part, horizontally above the I-beam's upper flange 28, as previously described).

The worker continues, to the extent possible, the relative movement of the channel member 35 and the other assemblies as described in the immediately preceding paragraphs, until no more relative movement can occur because: (in the manner illustrated in FIG. 1) the flange hook portion 68 of the left flange hook assembly 64 has engaged and is positioned against the left side (as viewed in FIG. 1) of that upper flange 28, and the vertical portion 40 of the channel member 35 has engaged and is positioned against the right side of that upper flange 28 (also as viewed in FIG. 1); and, in an equivalent manner, although hidden from view in FIG. 1, the flange hook portion of the right flange hook assembly has engaged and is positioned against that same left side of that upper flange 28.

Further threading or moving of the left quick-thread rod 62 will cause the threaded hexagonal left nut 70 to engage the rear face 76 of the rod receiver 66 of the left flange hook assembly 64, with the flange hook portion 68 of the left flange hook assembly 64 engaging and positioned against the left side (as viewed in FIG. 1) of the upper flange 28 as previously described. Similarly, further threading or moving of the right quick-thread rod will cause the threaded hexagonal right nut to engage the rear face of the rod receiver of the right flange hook assembly (not shown), with the flange hook portion of the right flange hook assembly (not shown) engaging and positioned against the left side (as viewed in FIG. 1) of the upper flange 28 as previously described.

As the final step in mounting the safety stanchion 10 securely upon the upper flange 28 of the horizontal I-beam 12 as shown in FIGS. 1 and 5, the worker first tightens jaw opening adjustment bolts 48*a* and 48*b* until they contact the underside of the I beam's flange. There is no need to torque these bolts. Hand tightening is sufficient since the primary purpose of the bolts is to adjust the jaw opening to correspond to the flange thickness. Then, the left and right wing nuts are tightened either by hand or by manually spinning them and then preferably striking them with a simple tool to turn each wing nut another half a turn or so. It should be noted that after the wing nuts have been firmly tightened (i.e. by inwardly threading it on its respective threaded rod), it is ordinarily unnecessary (although possible) to separately tighten, in addition, the threaded hexagonal left nut 70 and the threaded hexagonal right nut. This aforementioned design is advantageous since in most situations safety stanchion 10 can be firmly secured to an I-beam by hand tightening only.

Safety stanchion 10 is relatively light and may be installed simply, quickly and by hand, by a single worker. It may be installed (preferably along with another, neighboring safety stanchion 10 joined to it by a safety cable 14*a* or 14*b*) upon an I-beam 12 before the I-beam has been hoisted into its final position, and then be hoisted with the beam, or it may instead be installed upon an I-beam 12 after the I-beam has already been installed in its final position in a superstructure.

Through its use, the safety stanchion 10 provides a unique fall protection system. In its simplest form, this fall protection system includes two of the safety stanchions 10 mounted in line along one or more horizontal I-beams 12 forming part of a bridge, building, longspan, girder, roof peak or other structure. Of course, any number of safety stanchions 10 can be mounted in a row without interruption, so that the fall protection system can be extended indefinitely.

Also, a separate fall protection safety cable can be horizontally extended perpendicularly to a line of safety stanchions 10 that are already connected by other safety cables 14*a*, 14*b*, so as to intersect and be joined at right angles to that line by attachment either to one of the safety stanchions 10 directly, or instead by fixed or sliding perpendicular attachment to one of the other safety cables 14*a*, 14*b*. Such a perpendicular attachment is made possible because the safety stanchion 10 is able to resist loads (within design limits), as generated by falls, in any compass direction for three hundred and sixty degrees (360°) around the stanchion.

In their preferred embodiments, neighboring safety stanchions 10 can be spaced up to eighty (80) feet apart, or may have any closer spacing that would be more useful to the user, with the exact spacing planned to control possible total fall distances. In one alternative, one or more safety stanchions 10 can be placed in an intermediate position, between other safety stanchions 10, in order to lessen total fall distances or increase the maximum number of workers allowed within a given length of safety cable; as previously noted, such intermediate safety stanchions 10 could, but need not, be fitted with an alternative pass-through type cap such as that taught by U.S. Pat. No. 4,037,824, and could also, but need not, be fitted with a cap having more bores, so as to accommodate perpendicular cables as previously explained.

Once placed in a line, the safety stanchions 10 are used to vertically support and anchor one or more safety cables 14*a* or 14*b* sequentially above the particular I-beams 12 to which the safety stanchions 10 are attached, with any particular safety stanchion 10 ordinarily anchoring and supporting one or two safety cables (possibly together with one or more additional, perpendicular cables, as previously explained).

Ordinarily, each safety cable is supported and anchored at each end by a separate safety stanchion 10, so that any two neighboring safety stanchions 10 form, together with the safety cable that links them, a so-called section.

When the preferred embodiment of the safety stanchion is properly used, up to two workers can be supported simultaneously by each section. Preferably, each worker obtains support by clipping to one of the supported and anchored safety cables 14*a* or 14*b* a conventional lanyard 26 that is attached, at its other end, to a harness worn by the worker. In one alternative, a worker could even hook his or her lanyard 26 directly to the safety stanchion 10 itself, if bore 24*a* or 24*b* was then unused and therefore available. Preferably, each lanyard 26 is five to six feet (5' to 6') in length, so as to limit possible fall distances. As previously noted, it is also preferred that conventional lanyards of the shock absorbing type be used. Alternatively, a retractable lanyard could be used to further limit free fall, total fall distance, and the forces on the system and the user.

In the preferred embodiment, each safety stanchion 10 supports and anchors its safety cables at a height of approximately forty-two inches (42") above the upper flange 28 of the I-beam 12 to which the safety stanchion 10 is mounted.

At this height, a safety cable not only supports a worker's lanyard 26 but also provides the worker with a convenient hand grab to help the worker steady himself or herself. At this height, a safety cable also reduces free fall when compared to any shorter system or another lower tie-off point, thereby reducing the forces imposed, by a fall, upon the user and the fall protection system.

Once a worker has clipped his or her lanyard 26 to a supported and anchored safety cable 14*a* or 14*b*, the worker may walk along or work upon the I-beam 12 to which that safety cable is anchored and secured by way of the preferred safety stanchion 10, with the worker's lanyard 26 sliding along the safety cable as the worker moves. The oblique angle at which the tapered tubular post 36 of the safety stanchion 10 extends above the base assembly 34 allows that tapered tubular post 36, as well as the safety cables it supports, not only to provide a more conveniently placed hand grab, but also to facilitate the worker's passage along the beam with minimal interference from the safety stanchions 10 and the supported safety cables 14*a* or 14*b*.

As a worker reaches a safety stanchion 10, while moving along an I-beam 12 to which that safety stanchion 10 is mounted, the worker, before un-clipping his or her lanyard 26 from the particular safety cable 14*a* or 14*b* along which it has been sliding, first clips another, separate lanyard 26, which is also attached to his or her harness, to the next safety cable 14*a* or 14*b* that extends in the desired direction of travel.

Only after the other, separate lanyard 26 has been so clipped does the worker un-clip his first lanyard 26. In this fashion, the worker is clipped to a safety cable at all times, without interruption, so long as he or she is walking or working upon an I-beam 12 upon which safety stanchions 10, with their accompanying safety cables, are mounted. Of course, this system anticipates that each worker will at all times have two separate lanyards 26 attached to his or her harness, for what is commonly called "100% fall protection."

If a worker is properly clipped to a properly designed and installed safety system that incorporates safety stanchions 10, the safety stanchions support the safety cable 14*a* or 14*b* to which the worker is clipped, and thereby limits the worker's fall. Furthermore, the preferred safety stanchion 10 may flex and may permanently deform, as previously described, to reduce and absorb the shock and sudden load created by the worker's fall. These abilities to flex and to permanently deform provide the preferred safety stanchion 10 with what is, in effect, a built-in shock absorber.

Figure 7:
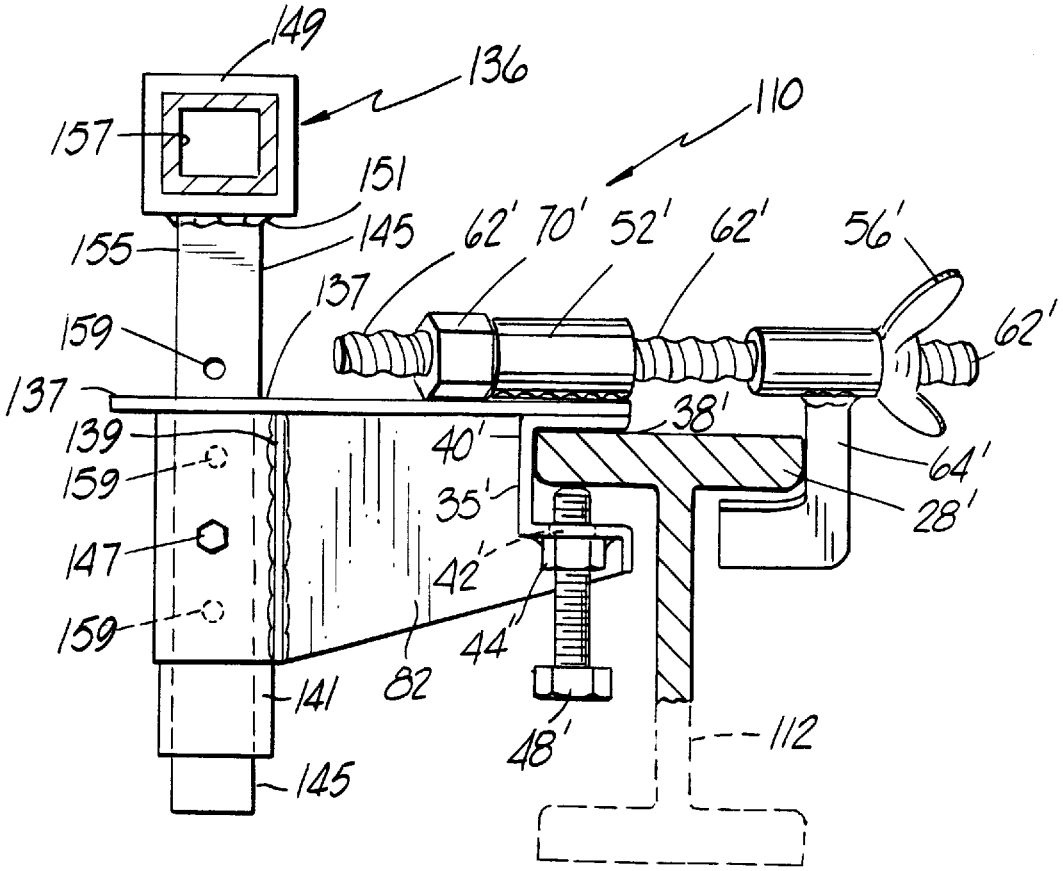
FIG. 7 is a cross-sectional view of another safety stanchion of the invention of the '809 patent taken along lines 7—7 of FIG. 8.
Figure 8:
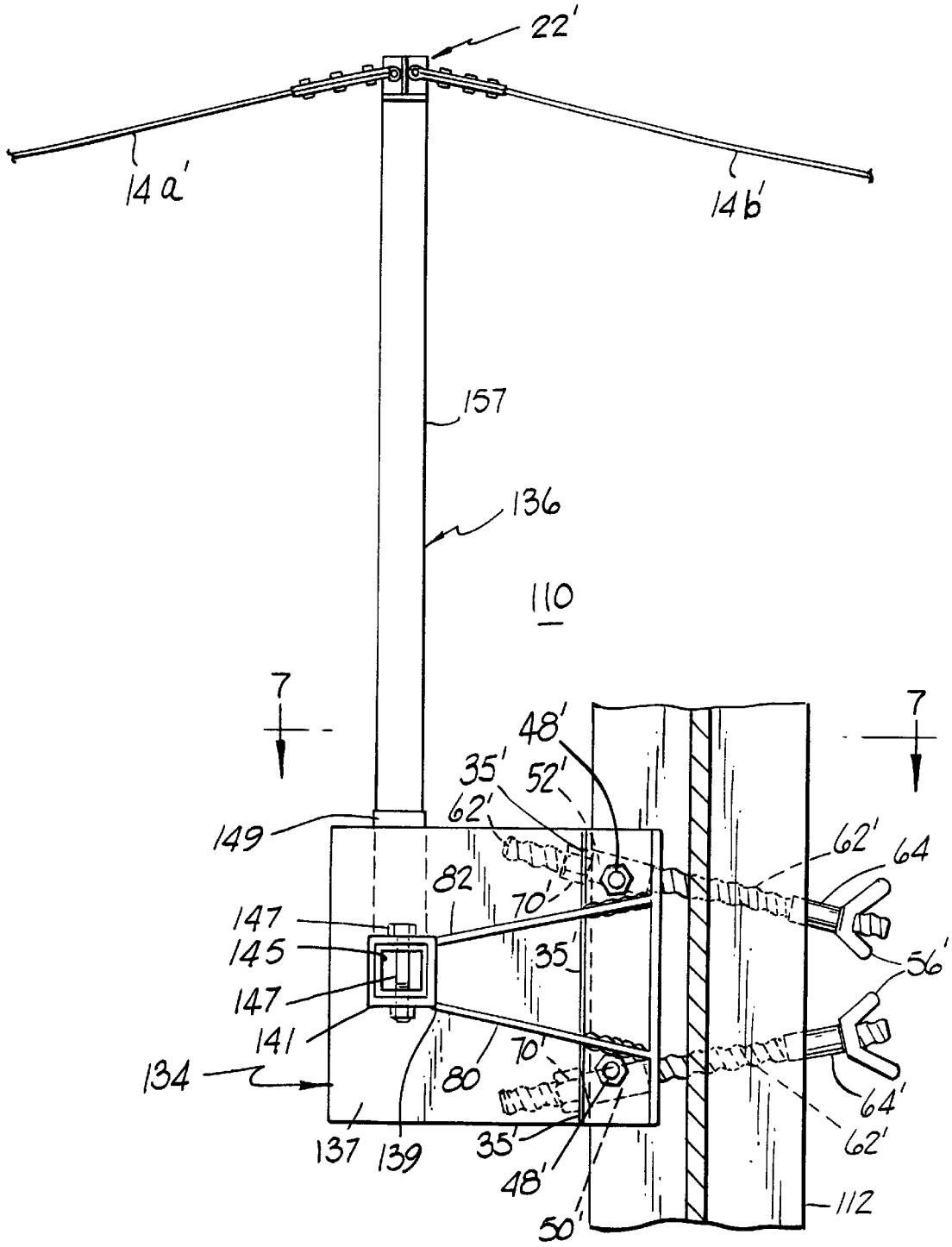
FIG. 8 is a front side elevational view of another safety stanchion of the invention of the '809 patent which is mounted to a structural I-beam column illustrated in section.
Figure 9:
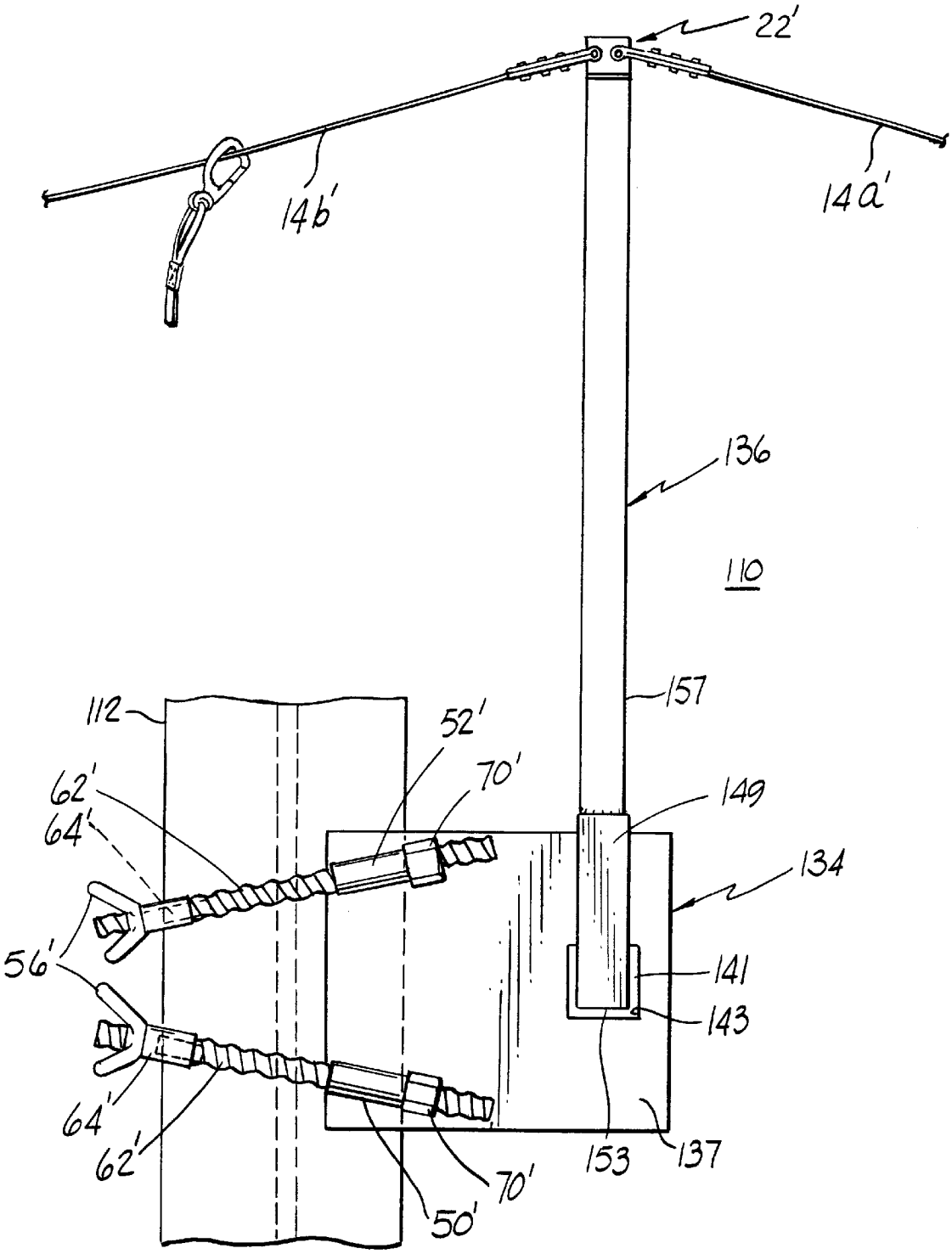
FIG. 9 is a rear side elevational view of the safety stanchion of FIG. 8.

FIGS. 7–9 illustrate another safety stanchion 110 of the invention of the '809 patent which is ideally suited for mounting to a vertically disposed I-beam column 112, as shown. A modified version, not shown, but quite similar may also be mounted to a horizontally disposed beam. The components of stanchion 110 (and its environment) which are identical or functionally equivalent to those of the previous embodiment will be identified with the same numbers used in the first embodiment. However, the numbers will be primed.

As shown, stanchion 110 has two primary components, a base assembly 134 and an L-shaped post 136 which is rigidly attached to base assembly 134 and which supports safety cables 14*a*' and 14*b*' at its upper end with a rigidly attached cap 22' in a manner similar to that described in the first embodiment.

Base assembly 134 is similar to base assembly 34 of the previous embodiment in that it also has a channel member 35' defining an open channel for receiving a side (not numbered) of flange 28' of I-beam column 112. Base assembly 134 further includes a base plate 137 which is welded as shown in FIG. 7 to the upper portion 38' of the channel member. As shown in FIG. 7, base plate 137 also has a pair of left and right gussets 80', 82' welded to its underside (not numbered) and to portions 40', 42' of channel member 35' which serve to strengthen and rigidify the base assembly. Gussets 80', 82' are also as shown in FIGS. 7 and 8 welded along welds 139 to a square tubular sleeve 141 which in turn is received in and welded to the sides (not numbered) of a square bore 143 provided in base plate 137. Gussets 80', 82' serve to rigidly maintain square tubular sleeve 141 in its perpendicular position relative to base plate 137 so that it is capable of supporting L-shaped post 136, the lower end or leg 145 of which is slidably and telescopingly received therein. As shown, lower end 145 is held in place in square tubular sleeve 141 and thereby prevented from sliding out of the sleeve by a bolt/nut means 147 which passes through both sleeve 141 and lower end 145.

Turning now to FIG. 9, it will be appreciated that base plate 137 also has a pair of rod receivers 50', 52' welded to its upper surface (not numbered). As shown, the rod receivers converge towards each other at an oblique angle of about 10 degrees in the manner previously described with respect to the first embodiment. As with the first embodiment, this arrangement serves to prevent "walking" or sliding of the base assembly down the column which is more of a problem in this embodiment since with a vertical column gravity is always acting on the base assembly.

As also shown, each rod receiver receives one end of a quick-thread rod 62' while the other end thereof is received in the bore (not numbered) of a flange hook 64'. A nut 70' and a wing nut 56' are also provided for each quick-thread rod which are respectively threaded onto the opposite ends thereof. As will be appreciated and as previously described in connection with the first embodiment, when nuts 70' and wing nuts 56' of each quick-thread rod are tightened, the flange 28' of the column is clamped by (or between) the pair of flange hooks 64' and the channel member 35' of the base assembly. Note, a close comparison of the first and second embodiments will reveal that the location of the wing nuts 56' and nuts 70' are reversed in the two embodiments. This reversing or switching of their respective positions has no effect on the functionality of the respective embodiment, i.e. both fundamentally function the same. In both embodiments it will be appreciated that the wing nut is threaded onto the end of the quick-thread rod which extends over open space which as those skilled in the art will appreciate permits threading of the wing nut onto the rod.

FIG. 8 illustrates that the base assembly is also provided with a pair of threaded bolts 48', each,of which is threadingly received in a nut 44' which is welded to the lower portion 42' of channel member 35'. Each threaded bolt 48' passes through a bore (not shown) in the lower portion 42' of channel member 35' so that bolts 48' can be tightened against the underside surface of the column's flange 28' as such is shown in FIG. 7.

When bolts 48' are tightened along with nuts 70' and wing nuts 56' on each quick-thread rod (note, the tightening of a wing nut will automatically tighten the associated nut 70' which has been threaded on the other end of the quick-thread rod), the base assembly will be securely affixed to the column. As previously mentioned in connection with the first embodiment, this unique design of the base assembly's means for securing or attaching the post to an I beam enables the base assembly to be securely attached to an I beam, even a vertical column as shown in the second embodiment, by simply hand tightening wing nuts 56' and bolts 48' or by simply banging on the wing nuts with a device. In most situations, there will be no need to torque these elements to a specific torque. This is advantageous in that it reduces the likelihood of a failure which could be caused by over tightening of the nuts or bolts which might strip the threads of the nuts or bolts.

Turning now to L-shaped post 136, as shown in the drawings, L-shaped post 136 includes three basic parts; (1) the previously mentioned lower end or leg 145 of L-shaped post 136 which is slidably and telescopingly received in square sleeve 141 of the base assembly, (2) an upright square tube-like central base portion 149 which is rigidly affixed, i.e. welded, as shown by weld line 151, at its lower end 153 to end 155 of lower leg 145 and (3) an upright square tube-like upper portion 157, the lower end (not numbered) of which is received in and rigidly affixed to, i.e. welded, to the square tube-like central base portion 149.

As can be visualized from the drawings, lower leg 145 is welded or joined to the central base portion at a right angle which is what provides post 136 with its L-shape. Cap 22' is rigidly attached, preferably welded, to the upper end (not numbered) of upper portion 157. Thus, it will be appreciated that the entire L-shaped post 136 including cap 22' is fundamentally a one piece component with no moving parts. It however, as previously mentioned, is slidably and telescopingly received in square sleeve 141 of the base assembly. As such, its telescoping position within sleeve 141 can be adjusted by adjusting the depth to which the lower leg 145 is received in square sleeve 141. In addition, the telescoping members 141, 145 can be held or locked in any one of a number of desired positions by inserting bolt/nut means 147 through the appropriate bore 159 of a number of bores 159 provided in lower leg 145 as such is shown in FIG. 7. As previously mentioned, bolt/nut means 147 locks or prevents slidable movement between leg 145 and sleeve 141 by passing through bores provided in both sleeve 141 and lower end 145 as such is shown in FIG. 8.

The ability to adjust the position of the L-shaped post relative to the base assembly by adjusting the telescoping position of members 141 and 145 as indicated is advantageous because it enables one to position the safety cables **14*a*' and 14*b*'** as desired. The ability to make such an adjustment in a column mounted application is particularly important because the horizontal I-beam (not shown) which is walked upon by the construction workers is not always in the same position relative to the column. That is, in some situations its outer edges may be closer to the vertical plane of the column and in other situations it may be farther away. Thus, the ability to adjust the position of the post enables one to adjust the position of the safety cables so that they are within the easy reach of a construction worker walking on the adjacent I-beam. This quite obviously is an important safety feature of this embodiment.

As will also be appreciated, the two piece nature of this embodiment makes it relatively easy to install since with two pieces each piece is significantly lighter than one combined unit. Also, all components of this embodiment i.e. safety stanchion 110 may be made from conventional steel. However, to reduce weight certain components may be made from aluminum or other alloys including thinner gauge steel with higher strength and flexion properties.

Figure 10:
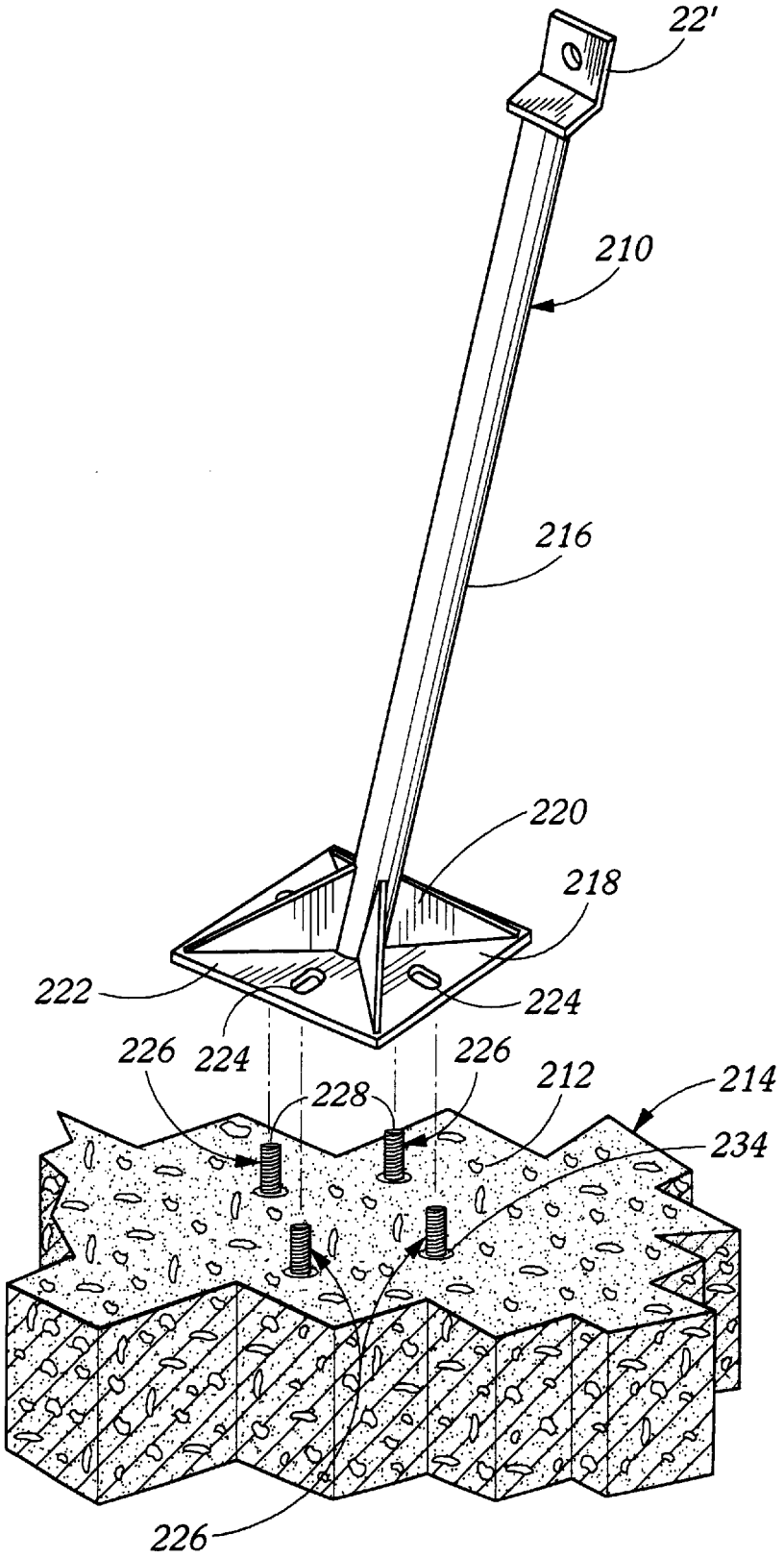
FIG. 10 is perspective view of an embodiment of the present invention for direct mounting of a safety stanchion to a concrete structure.

FIGS. 10 through 16 illustrate that several apparatus and methods of the present invention for mounting a safety stanchion to a concrete structure. As shown in FIG. 10, a safety stanchion 210 is provided for direct mounting to a flat surface 212 of a concrete floor or structure 214. Stanchion 210 has a post 216 with means or cap 22' attached to its top end for supporting a safety cable. Post 216 may be of uniform width or frustoconical as shown in FIG. 1. At its bottom end, post 216 is rigidly attached, preferably welded, to a base (not numbered) which includes a mounting plate 218 and several strengthening gussets 220 for mounting the stanchion to the concrete surface. Plate 218 has a generally flat bottom surface (not shown) for placement against the flat surface 212 of the concrete structure. The mounting plate also has a top surface 222 and a plurality of holes 224 extending through the plate from the bottom surface to the top surface.

Figure 14:
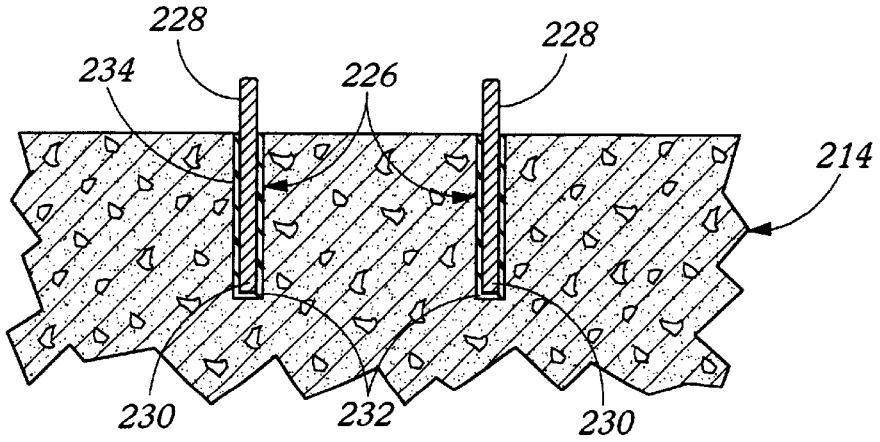
FIG. 14 is a cross-sectional view taken along lines 14—14 of FIG. 13. The bolts 226 of this embodiment for anchoring a safety stanchion in a concrete structure are also shown in FIG. 10.

As indicated in FIG. 10, stanchion 210 is secured to the concrete structure with four elongated bolts 226 which are anchored in the concrete structure as well as four wing nuts (not shown) such as wing nuts 56 of FIG. 1 which thread onto the exposed threaded ends 228 of the bolts which preferably have aggressive threads as previously described. As shown in FIG. 14, bolts 226 are anchored a predetermined depth in the concrete structure with their first end 230 received in an hole or bore 232 provided in the concrete structure and their second threaded end 228 projecting out of the hole a distance which is sufficient to pass through and project outwardly from a hole 224 of the mounting plate 218. As also shown, the bolts are secured in holes 232 with an epoxy or grout 234 such as those available from Dayton Superior of Dayton, Ohio which has been found to provide a good bond between the bolt and the concrete. To enhance the bond between the bolts and the concrete, the bolts are preferably threaded along their entire length. This provides the bolt with more surface area to which the epoxy can bond. The portion of the bolt embedded in the concrete should also preferably have a length to width ratio of at least 8 to 1 for a secure bond. In the alternative, a shorter headed bolt or a bolt with a nut on one end could be employed to increase adhesion or the force required to pull the member out of the concrete.

The method for mounting safety stanchion 210 to concrete structure 214 using the aforementioned components includes the steps of providing the four elongated holes 232 in the concrete structure with the holes arranged so that they align with holes 224 provided in the stanchion's mounting plate 218. In addition, holes 232 are sized so that they are capable of receiving the first ends 230 of the bolts 226 and allowing the second threaded ends 228 of the bolts to project out of the holes a distance which is sufficient to enable the bolts to pass through and project outwardly from holes 224 of the mounting plate 218. The method further includes the step of placing epoxy 234, preferably quick cure type, and an elongated bolt 226 in each elongated hole 232 to adhesively secure the bolts in the holes. The stanchion is then mounted to the concrete structure by placing the stanchion's base on the exposed threaded ends 228 of the bolts so that the ends pass through and project outwardly from the holes 224 of the base's mounting plate 218. Nuts, preferably wing nuts such as wing nuts 56 of FIG. 1, are then threaded onto the exposed threaded ends 228 of the bolts until the stanchion's base, i.e. mounting plate 218, is securely attached to the concrete structure.

Figure 11:
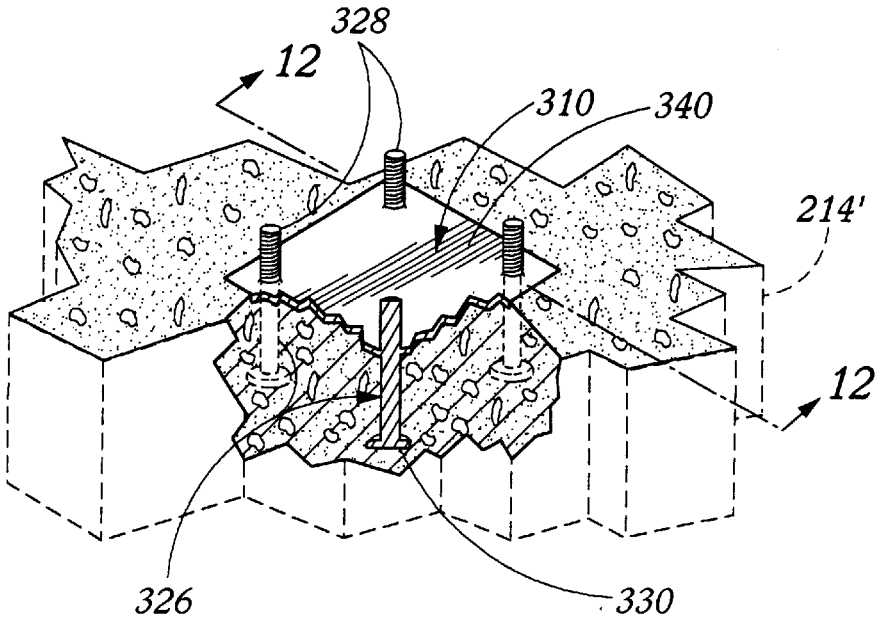
FIG. 11 is a partially broken away perspective view of an embed of the present invention for mounting a safety stanchion to a concrete structure.
Figure 12:
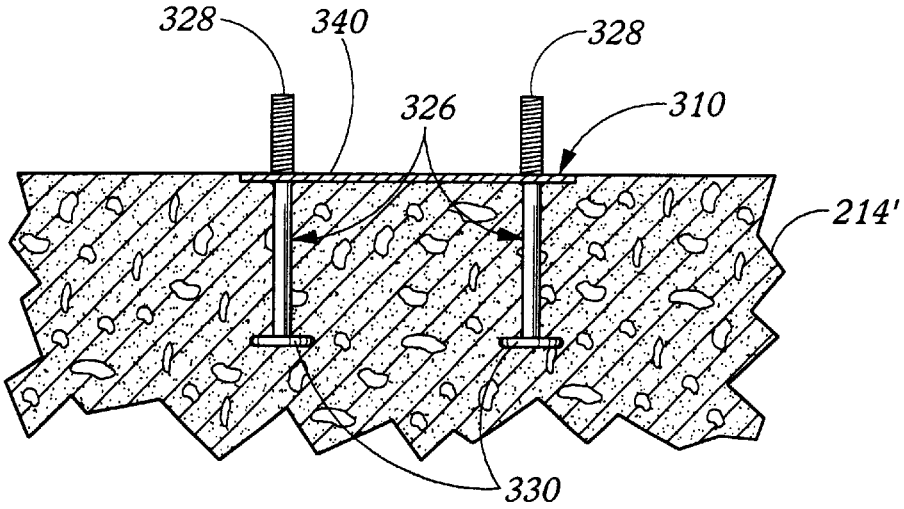
FIG. 12 is a cross-sectional view taken along lines 12—12 of FIG. 11.

FIGS. 11 and 12 illustrate a structure referred to as an embed 310 for aligning elongated bolts 326 similar to bolts 226 and for insuring that the bolts are securely anchored to the concrete structure 214'. As shown, embed 310 includes four elongated bolts 326 each of which has a first end or bolt head 330 for being embedded in the concrete structure and a second threaded end 328 for projecting outwardly from the concrete structure. Embed 310 also includes a preferably metal or plastic plate 340 which is provided with four holes (not numbered) for receiving bolts 326 which are rigidly connected to the plate (or held thereto) for assuring alignment of bolts with the plate 218 and holes 224. Four nuts (not shown) such as wing nuts 56 of FIG. 1 are also provided for threading onto the exposed ends 328 of the bolts to secure a safety stanchion such as stanchion 210 of FIG. 10 to the concrete structure.

To mount a safety stanchion such as stanchion 210 to concrete structure 214' using embed 310, one first pours concrete for forming the concrete structure. One then embeds or positions embed 310 in the poured concrete so that the threaded ends 328 of the embed project outwardly from the poured concrete and the alignment plate 340 is roughly at the same plane as the surface of the concrete. The user will then be assured, with a high degree of engineering certainty that without any field installation audits, testing or oversight that the design engineered strength is achieved based on the depth of embedment. A safety stanchion such as stanchion 210 is then mounted on the embedded embed by placing the base of the stanchion on the threaded ends 328 of the embed 310 so that the threaded ends pass through and project outwardly from the holes 224 of the stanchion's mounting plate 218. Nuts such as wing nuts 56 of FIG. 1 are then threaded onto the threaded ends 328 of the embed to secure the base of the stanchion to the concrete structure. Sufficient time should then be allowed to pass before use of the stanchion so that the poured concrete cures to its minimum design strength.

Figure 15:
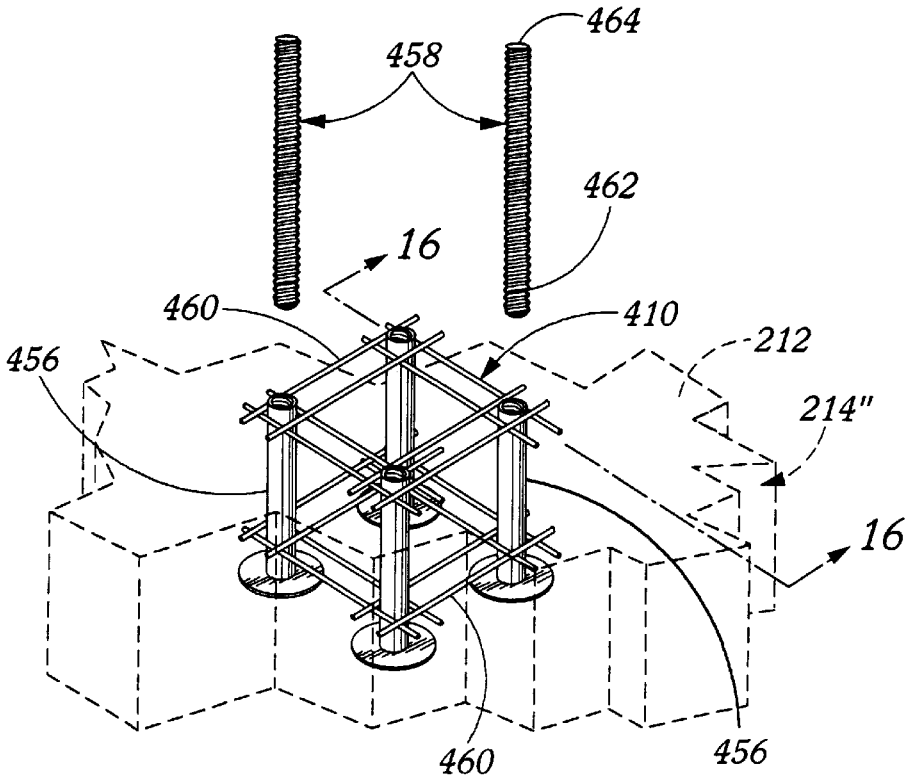
FIG. 15 is a perspective view of another embed of the present invention for mounting a safety stanchion to a concrete structure.
Figure 16:
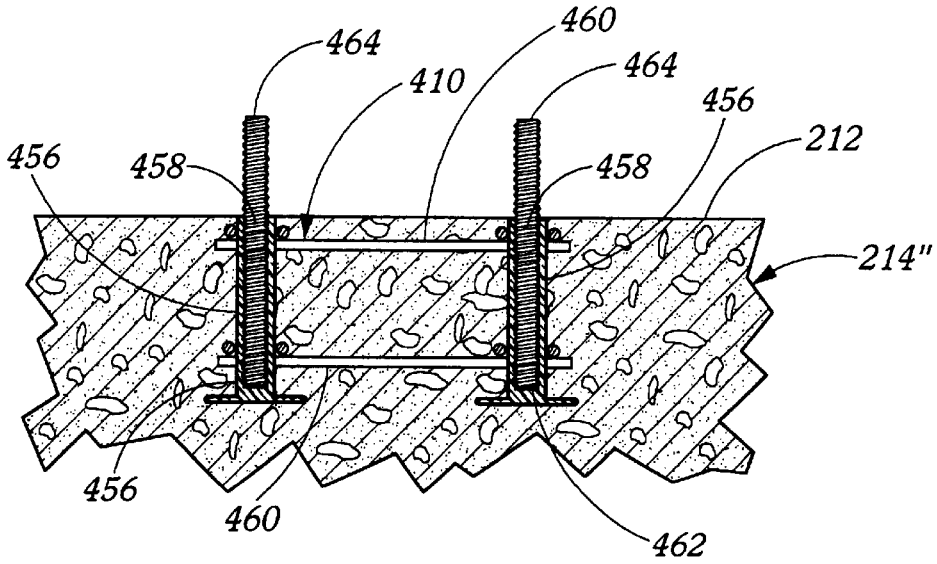
FIG. 16 is a cross-sectional view taken along lines 16—16 of FIG. 15.

FIGS. 15 and 16 illustrate an alternative embed 410 of the present invention which differs from embed 310 in that instead of using elongated bolts such as bolts 326 embed 410 includes four elongated female threaded inserts 456 for receiving threaded male members 458. In addition, instead of using a plate 340 embed 410 uses a plurality of preferably metal or plastic rods 460 or welded wire at one or more elevations within the concrete (two as shown in FIGS. 15, 16) which are welded or otherwise attached to the exterior surface of the threaded inserts (or are holding the inserts) to align and space the inserts. The threaded members 458 have opposing first and second threaded ends 462, 464 respectively, the first end of which is threaded or threadably received in a threaded insert 456 a predetermined distance so that the second threaded end projects outwardly from the threaded insert a predetermined distance. Four nuts (not shown) such as wing nuts 56 of FIG. 1 are also provided for threading onto the exposed ends 464 of the threaded members to secure the stanchion to the concrete structure. Ideally aggressively threaded nuts or wing nuts should be used to enable the installer to fixedly secure the stanchion to the concrete without having to use any tools. The aggressive threads also enable the embeds to be used with concrete without having to worry about concrete contamination which in all likelihood would disable a standard or finely threaded bolt.

The method for mounting a safety stanchion such as stanchion 210 using embed 410 is similar to that for embed 310 in that concrete for forming the concrete structure 214" is first poured and then the embed is embedded in the poured concrete so that the threaded inserts are embedded in the poured concrete with the first ends 462 of the threaded members threaded into the inserts and the second threaded ends 464 of the threaded members projecting outwardly from the poured concrete a predetermined distance. The safety stanchion may then mounted to the embed by placing the stanchion's base on the exposed threaded ends 464 of the threaded members threaded into the inserts so that the threaded ends pass through and project outwardly from the holes of the stanchion's mounting plate. Aggressively threaded nuts or wing nuts as described above are then threaded onto the exposed threaded ends 464 of the threaded members to secure the stanchion's base to the concrete structure. Sufficient time should then be allowed to pass before use of the stanchion so that the poured concrete cures to its minimum design strength.

Figure 13:
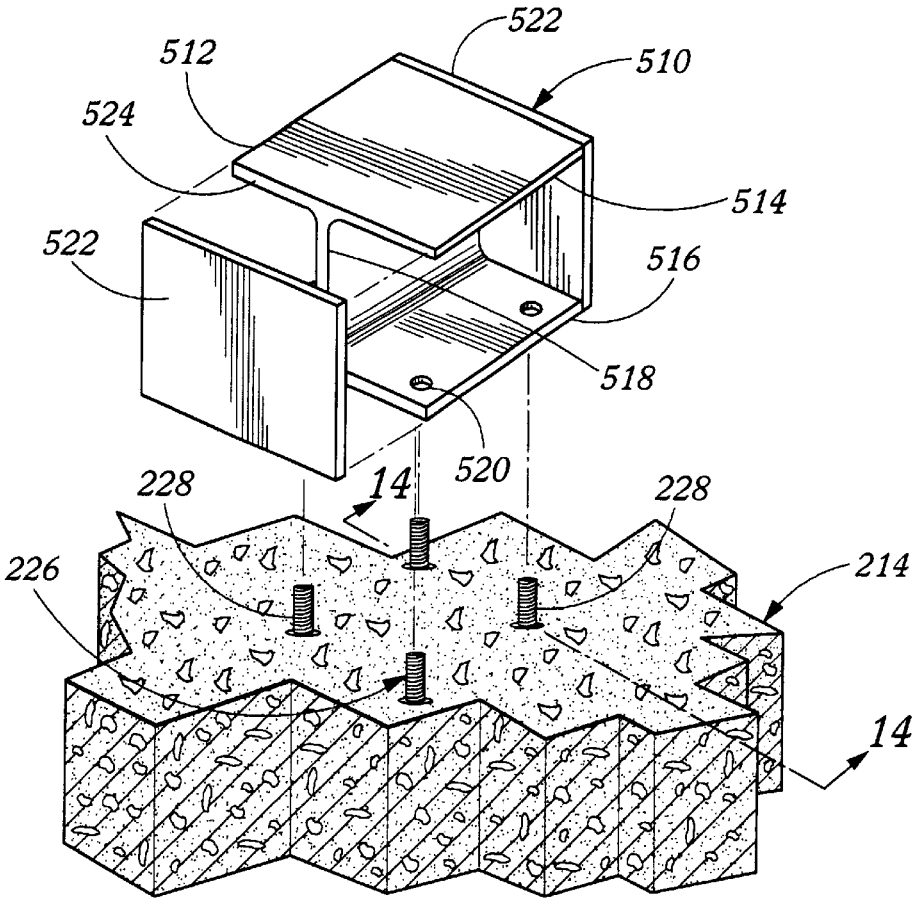
FIG. 13 is a perspective view of a mounting adaptor of the present invention for mounting a safety stanchion to a concrete structure.

FIG. 13 illustrates a safety stanchion mounting adaptor 510 for enabling safety stanchions which are normally mounted to a structural member such as an I beam to be mounted to a concrete floor, concrete beam or girder or other form of structural concrete. As shown, mounting adaptor 510 includes an I beam segment 512 of the type having parallel upper and lower flanges 514, 516 respectively which are connected by a center section 518 commonly known as the web. The I beam segment 512 preferably has a length less than four times the width of its upper and lower flanges. In addition, the lower flange 516 is provided with a plurality (four as shown) of holes 520 extending through the flange's cross-section for receiving threaded ends 228 so that the segment can be secured to a generally flat concrete floor or other flat concrete surface when nuts such as wing nuts 56 are threaded onto ends 228.

In addition, the mounting adaptor preferably includes at least one strengthening plate 522 which is rigidly connected, preferably welded, to an end 524 of the adaptor. As shown, adaptor 510 has a pair of strengthening plates 522 with one welded to each end 524 of the adaptor's segment 512. As also shown, the strengthening plates connect and are welded to both the upper and lower flanges 514, 516 of the segment, thereby providing an extremely strong mounting adaptor. In addition, the strengthening plates serve to capture the mounted base of the stanchion within the ends of the adaptor, thereby preventing the stanchion from moving horizontally or walking as referred to earlier off an end of the beam.

To mount adaptor 510 to a concrete floor or other flat surface, one places the adapter on the flat surface so that the lower flange of the adapter is against the flat surface with the threaded ends 228 of bolts 226 extending through the adaptor's holes 520. The adaptor is then secured to the flat surface by threading nuts such as wing nuts 56 of FIG. 1 on the threaded ends 228 of the bolts. A safety stanchion of the type normally mounted to an I beam may then be mounted on the adaptor. This simply involves placing the safety stanchion's base on the upper flange of the adaptor and securing it to the upper flange as previously described in connection with the embodiments of FIGS. 1 through 9. It will also be appreciated that adaptor 510 can be mounted to a concrete surface with either of the foregoing embeds.

While preferred embodiments of the present invention have been shown and described, it is to be understood that this was done only by way of example, and not as a limitation upon the scope of the invention.

I claim:

1. A safety stanchion mounting adaptor for mounting a safety stanchion to a concrete structure having a flat surface wherein the safety stanchion has a post with first and second ends, means for supporting a safety cable at said first end of said post and a base attached to said second end of said post, said adaptor comprising:

a beam segment for mounting to said second end of said post, said beam segment having parallel upper and lower flanges connected by a center section wherein said segment has a length less than four times the width of its upper or lower flanges said upper flange is adapted to be attached to said second end of the post, and wherein said lower flange is provided with a plurality of holes extending through said lower flange's cross-section for receiving threaded members projecting from the concrete structure to secure said beam segment to a the generally flat surface of the concrete structure.

2. The safety stanchion mounting adaptor as claimed in claim 1 further comprising a strengthening plate rigidly connecting said upper and lower flanges at one end of said adaptor.

3. The safety stanchion mounting adaptor as claimed in claim 1 further comprising strengthening plates rigidly connecting said upper and lower flanges at both ends of said adaptor.

4. A method for mounting a safety stanchion apparatus to a concrete structure having a generally flat surface, said method comprising:

providing a safely stanchion apparatus including:

a post having first and second ends;

means for supporting a safety cable at said first end of said post;

a base attached to said second end of said post; and an adaptor including a beam segment for mounting to said second end of said post, said beam segment having parallel upper and lower flanges connected by a center section wherein the said segment has a length less than four times the width of its upper or lower flanges and wherein said lower flange is provided with a plurality of holes extending through the said lower flange's cross-section for receiving fasteners to secure said beam segment to the generally flat surface of the concrete structure;

placing the adapter on the concrete structure so that the lower flange of the adapter is against the generally flat surface of the concrete structure, securing the adaptor to the concrete structure with said fasteners passing through the holes of the adaptor's lower flange; and placing the stanchion's base attached to the post on the upper flange of the adaptor; and securing the base to the upper flange to mount the stanchion on the adaptor.

5. The method as claimed in claim 4 wherein the step of securing the adaptor to the concrete structure includes the steps of:

providing a plurality of bolts, each of which has a first end for receipt in a hole provided in the concrete structure and a second threaded end for projecting out of the elongated hole a distance which is sufficient to pass through and project outwardly from a said hole of the adaptor's lower flange;

providing a plurality of nuts for threading on the second threaded ends of said bolts;

providing a member selected from the group consisting of epoxy and grout for securing said first end of each bolt in a hole provided in the concrete structure;

providing a plurality of holes in the concrete structure having a generally flat surface with the holes being arranged so that they align with the holes provided in the adaptor's lower flange, each said hole also being sized to receive the first end of a bolt so that the second threaded end of the bolt projects out of the elongated hole a distance which is sufficient to pass through and project outwardly from a said hole of said adaptor's lower flange;

placing a member selected from the group consisting of epoxy and grout and a said bolt in each said hole to adhesively secure a said bolt in each said hole;

placing the adaptor on the second threaded ends of said bolts secured in said holes so that the threaded ends pass through and project outwardly from the holes of said adaptor's lower flange;

threading the nuts onto the second threaded ends of the bolts projecting outwardly from the holes of said adaptor's lower flange to secure the adaptor to the concrete structure.

6. The method as claimed in claim 4 wherein the step of securing the adaptor to the concrete structure includes the steps of:

providing an embed rigidly for supporting a plurality of bolts, each of which has a first end for being embedded in the concrete structure and a second threaded end for projecting outwardly from the concrete structure, said bolts also being supported by said embed so that the threaded second ends of said bolts are capable of aligning with the holes of said adaptor's lower flange and being received in the holes;

providing a plurality of nuts for threading on the second threaded ends of said bolts;

pouring concrete for the concrete structure;

embedding the embed in the poured concrete so that the first ends of the bolts are embedded in the poured concrete with the second threaded ends of the embed projecting outwardly from the poured concrete;

placing said adaptor on the second threaded ends of the bolts of the embed so that the threaded ends pass through and project outwardly from the holes of said adaptor:

threading the nuts onto the second threaded ends of the bolts projecting outwardly from the holes of the adaptor to secure the adaptor to the concrete structure.

7. The method as claimed in claim 4 wherein the step of securing the adaptor to the concrete structure includes the steps of:

providing a plurality of threaded members having first and second threaded ends;

providing an embed rigidly supporting a plurality of threaded inserts each of which threadably receives the first end of a threaded member so that the second threaded end of each threaded member projects outwardly from the threaded insert, said threaded inserts also being supported by said embed so that the threaded second ends of said received threaded members are capable of aligning with the holes of the adaptor's lower flange and being received in the holes; and providing a plurality of nuts for threading on the second threaded ends of said threaded members;

pouring concrete for the concrete structure;

embedding the embed in the poured concrete so that the threaded inserts are embedded in the poured concrete with the first ends of the threaded members threaded into the inserts and the second threaded ends of the threaded members projecting outwardly from the poured concrete;

placing the adaptor on the second threaded ends of the threaded members threaded into the inserts of the embed so that the threaded ends pass through and project outwardly from the holes of the adaptor's lower flange;

threading the nuts onto the second threaded ends of the threaded members projecting outwardly from the holes of the adaptor's lower flange to secure the adaptor to the concrete structure.

8. A safety stanchion apparatus for mounting to a concrete structure having a generally flat surface, said stanchion apparatus comprising:

a post having first and second ends;

means for supporting a safety cable at said first end of said post;

a base attached to said second end of said post; and, a safety stanchion mounting adaptor including a beam segment for mounting to said second end of said post, said beam segment having parallel upper and lower flanges connected by a center section wherein said lower flange is provided with a plurality of holes extending through said lower flange's cross-section for receiving fasteners to secure said beam segment to the generally flat surface of the concrete structure.

9. The safety stanchion apparatus as claimed in claim 8 comprising a strengthening plate rigidly connecting said upper and lower flanges at one end of said adaptor.

10. The safety stanchion apparatus as claimed in claim 8 further comprising strengthening plates rigidly connecting said upper and lower flanges at both ends of said adaptor.

* * * * *